US009444193B1

(12) United States Patent
Westman et al.

(10) Patent No.: US 9,444,193 B1
(45) Date of Patent: Sep. 13, 2016

(54) ELECTRICAL CONNECTOR ASSEMBLY AND CABLE ASSEMBLY HAVING A CONDUCTIVE GASKET TO REDUCE ELECTROMAGNETIC LEAKAGE

(71) Applicant: Tyco Electronics Corporation, Berwyn, PA (US)

(72) Inventors: John Eugene Westman, Harrisburg, PA (US); Richard Elof Hamner, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/680,216

(22) Filed: Apr. 7, 2015

(51) Int. Cl.
*H01R 13/6592* (2011.01)
*H01R 13/6586* (2011.01)
*H01R 13/6581* (2011.01)
*H01R 13/502* (2006.01)

(52) U.S. Cl.
CPC ..... *H01R 13/6581* (2013.01); *H01R 13/502* (2013.01)

(58) Field of Classification Search
CPC ..... H01R 13/6592; H01R 13/6586; H01R 13/6584; H01R 13/6581
See application file for complete search history.

(56) References Cited

U.S. PATENT DOCUMENTS 4,599,680 A * 7/1986 Gibson ..... B64G 1/50 257/713
5,259,792 A * 11/1993 Beck ..... H01R 23/662 439/607.49
5,504,655 A * 4/1996 Underwood ..... H02M 7/003 200/50.1
5,825,634 A * 10/1998 Moorehead, Jr. .... H05K 9/0035 174/372
5,880,930 A * 3/1999 Wheaton ..... H05K 7/20409 165/80.3
6,856,769 B1 * 2/2005 Steffensen ..... G02B 6/4246 385/94
7,682,195 B2 * 3/2010 Yuan ..... H01R 13/648 439/607.35
7,997,909 B2 * 8/2011 Xu ..... H01R 13/6658 439/607.57
8,500,487 B2 * 8/2013 Morgan ..... H01R 13/6587 439/607.06
8,764,487 B2 * 7/2014 Ballard ..... H01R 13/6215 439/607.47
2002/0028604 A1 * 3/2002 Lo ..... H01R 9/035 439/607.56
2007/0211445 A1 * 9/2007 Robinson ..... H01L 23/552 361/818
2007/0280838 A1 * 12/2007 Otte ..... F04B 27/005 417/360
2009/0207579 A1 * 8/2009 Boetto ..... H05K 9/0016 361/818
2011/0103797 A1 * 5/2011 Oki ..... G02B 6/4201 398/79
2011/0260413 A1 * 10/2011 Voltenburg ..... F16J 15/062 277/644
2013/0323970 A1 * 12/2013 Wang ..... H01R 13/6471 439/607.08
2014/0024257 A1 * 1/2014 Castillo ..... H01R 13/6585 439/607.05
2014/0134073 A1 * 5/2014 Fuller ..... G01N 1/18 422/411

* cited by examiner

*Primary Examiner* — Gary Paumen

(57) ABSTRACT

Electrical connector assembly includes a housing assembly having first and second housing shells that are coupled to each other along a housing seam and define an interior cavity therebetween. The housing seam extends along a three-dimensional (3D) path. The electrical connector assembly also includes an electrical connector having a back end that is disposed within the interior cavity and a front end that is configured to mate with an external mating connector. The electrical connector also including a conductive gasket having a 3D gasket frame that substantially matches the 3D path of the housing seam. The 3D gasket frame being a discrete structure that is positioned along the housing seam to reduce electromagnetic interference (EMI) leakage through the housing seam.

20 Claims, 10 Drawing Sheets

ELECTRICAL CONNECTOR ASSEMBLY AND CABLE ASSEMBLY HAVING A CONDUCTIVE GASKET TO REDUCE ELECTROMAGNETIC LEAKAGE

BACKGROUND

The subject matter herein relates generally to cable assemblies that include cable harnesses for interconnecting communication systems or devices.

Communication systems, such as routers, servers, switches, redundant arrays of inexpensive disks (RAIDs), uninterruptible power supplies (UPSs), host bus adapters (HBAs), supercomputers, and the like, may be large complex systems that have a number of components interconnected to one another through different types of cable assemblies. For example, cable backplane (or cable midplane) systems include several daughter card assemblies that are interconnected to one another through cable assemblies. The daughter card assemblies of such systems may also be interconnected with remote components or devices through different types of cable assemblies. An example of such cable assemblies includes pluggable input/output (I/O) cable assemblies.

Cable assemblies may include a cable harness (or multi-core cable), one or more electrical connectors, and a housing assembly that holds the electrical connector(s) and is coupled to the cable harness. The electrical connector may be positioned within an interior cavity of the housing assembly and have a front end that is presented to an exterior of the housing assembly. The cable harness has multiple individual cables that are received through a loading passage of the housing assembly. When the cable assembly is fully constructed, an interior cavity exists within the housing assembly. The individual cables extend through the interior cavity and couple to corresponding contacts of the electrical connector that may be located, for example, at a back end of the electrical connector.

The housing assembly typically includes multiple housing shells. Each housing shell may interface with one or more other housing shells or an electrical connector along one or more seams. It is known that the seam(s) of the housing assembly are associated with electromagnetic interference (EMI) leakage in which EMI generated from within the interior cavity may escape to an exterior. Conductive gaskets may be positioned along the seams to control the EMI leakage. The conductive gaskets may include spring contacts or fingers or, alternatively, a conductive elastomer. These conductive gaskets, however, may be difficult to position along seams that have complex geometries.

Accordingly, a need remains for a cable assembly having effective EMI control along a seam with a complex geometry.

BRIEF DESCRIPTION

In an embodiment, an electrical connector assembly is provided that includes a housing assembly having first and second housing shells that are coupled to each other along a housing seam and define an interior cavity therebetween. The housing seam extends along a three-dimensional (3D) path. The electrical connector assembly also includes an electrical connector having a back end that is disposed within the interior cavity and a front end that is configured to mate with an external mating connector. The electrical connector also including a conductive gasket having a 3D gasket frame that substantially matches the 3D path of the housing seam. The 3D gasket frame being a discrete structure that is positioned along the housing seam to reduce electromagnetic interference (EMI) leakage through the housing seam.

Optionally, the conductive gasket is stamped or cut from a sheet of conductive material and shaped to have the 3D gasket frame. For example, a sheet of conductive material may be stamped or die-cut to provide a gasket blank. The gasket blank may be shaped to form the 3D gasket frame.

In an embodiment, a cable assembly is provided that includes a cable harness including insulated cables and a housing assembly having first and second housing shells. The first and second housing shells are coupled to each other along a housing seam and define an interior cavity therebetween. The housing seam extends along a three-dimensional (3D) path. The housing assembly includes a loading passage that receives the insulated cables of the cable harness. The cable assembly includes an electrical connector having a back end that is disposed within the interior cavity and a front end that is configured to mate with an external mating connector. The back end is coupled to the insulated cables. The cable assembly also includes a conductive gasket having a 3D gasket frame that substantially matches the 3D path of the housing seam. The 3D gasket frame is a discrete structure that is positioned along the housing seam to reduce electromagnetic interference (EMI) leakage through the housing seam.

DETAILED DESCRIPTION

Embodiments set forth herein include electrical connector assemblies, such as cable assemblies. The electrical connector assemblies include housing assemblies that are configured to hold one or more electrical connectors that are configured to transmit electrical power and/or data signals. The housing assembly includes an interior cavity where at least a portion of the electrical connector is located. In certain embodiments, the housing assemblies have one or more loading passages (or ports) that receiving insulated cables from, for example, a cable harness. The insulated cables are terminated to corresponding electrical contacts of the electrical connector(s) within the interior cavity. As set forth herein, the housing assemblies are configured to contain electromagnetic interference (EMI) that is generated within the housing assemblies by the electrical connectors and/or insulated cables.

Figure 1:
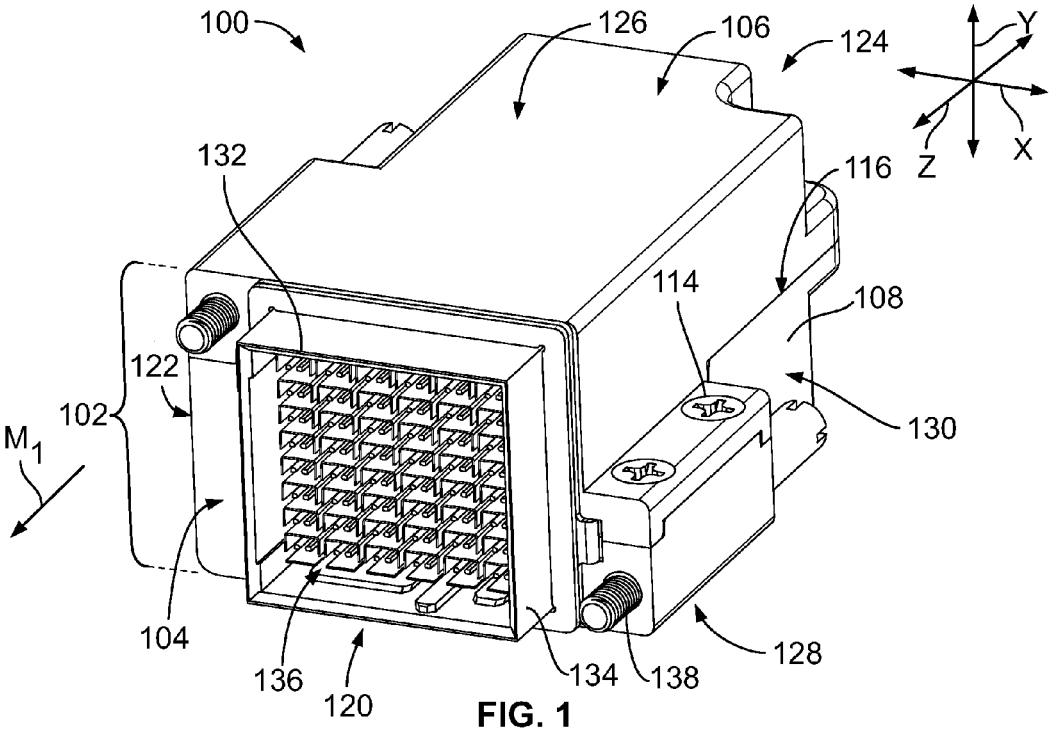
FIG. 1 is a front perspective view of an electrical connector assembly formed in accordance with an embodiment.
Figure 2:
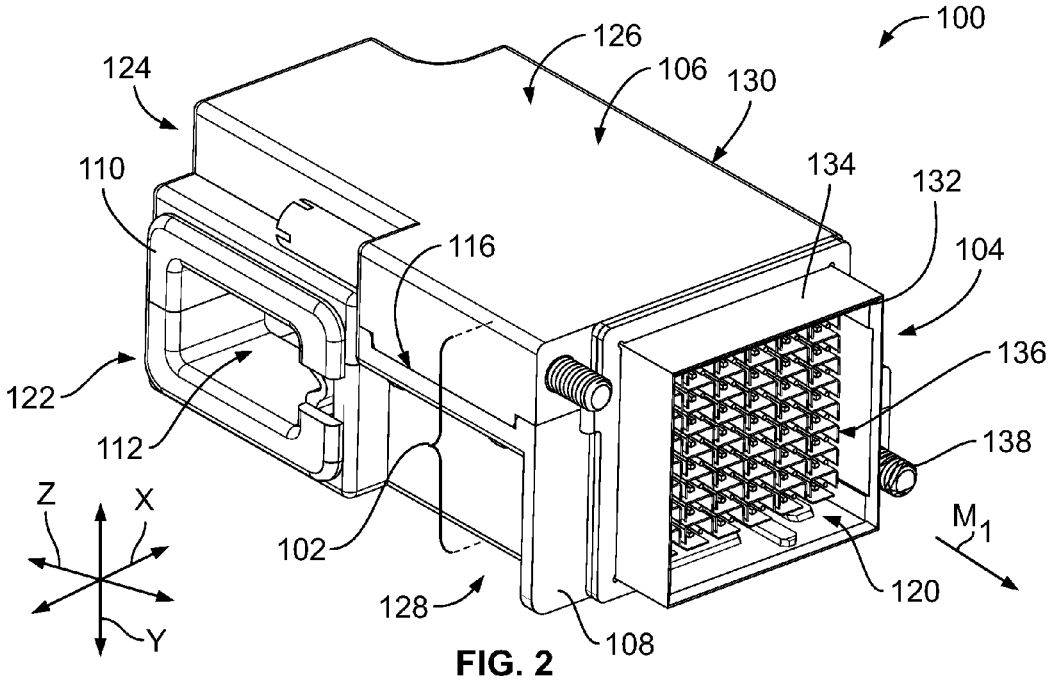
FIG. 2 is another front perspective view of the electrical connector assembly of FIG. 1.

FIGS. 1 and 2 are perspective views of an electrical connector assembly 100 that includes a housing assembly 102 and an electrical connector 104 that is held by the housing assembly 102. For reference, the electrical connector assembly 100 is oriented with respect to mutually perpendicular X, Y, and Z axes. In an exemplary embodiment, the electrical connector assembly 100 is configured to engage a cable harness assembly (not shown) that has a plurality of insulated cables and an optional shielding layer that surrounds the insulated cables. For example, the cable harness may be similar or identical to the cable harnesses 180 and 406 (shown in FIGS. 5 and 14, respectively). Accordingly, the electrical connector assembly 100 is hereinafter referred to as a cable assembly, but it should be understood that embodiments may include other types of electrical connector assemblies that do not include a cable harness or insulated cables. In certain embodiments, the housing assembly 102 may be referred to as a backshell or cable clamp.

The housing assembly 102 includes a plurality of structures that are coupled to one another to contain at least a portion of the electrical connector 104 and the insulated cables (not shown) within the housing assembly 102. For example, the housing assembly 102 includes first and second housing shells 106, 108 that are secured together to form an interior cavity 125 (shown in FIG. 10). The electrical connector 104 and the insulated cables are positioned within the interior cavity 125. The first and second housing shells 106, 108 are joined to each other along a housing seam 116. As described herein, embodiments may be configured to reduce EMI leakage through the housing seam 116.

The housing seam 116 extends along or forms a three-dimensional (3D) path such that housing seam 116 extends along each of the X, Y, and Z axes. In some embodiments, the entire 3D path may define a space that is substantially equal to or larger than the interior cavity 125 (shown in FIG. 10). The 3D path may surround the electrical connector 104 within the housing assembly 102. By way of example, at least one portion of the housing seam 116 may extend generally parallel to a plane defined by the X and Y axes (hereinafter the XY plane), at least one portion of the housing seam 116 may extend generally along a plane defined by the Y and Z axes (hereinafter the YZ plane), and at least one portion of the housing seam 116 may extend generally along a plane defined by the X and Z axes (hereinafter XZ plane).

Optionally, the housing assembly 102 also includes a grommet 110 (FIG. 2) that defines a loading passage 112 (FIG. 2) that provides access to the interior cavity 125 (FIG. 10) and is configured to receive the cable harness. In FIG. 2, the grommet 110 is positioned between the first and second housing shells 106, 108. In other embodiments, however, the grommet 110 may only couple to the first housing shell 106 or the second housing shell 108. The housing assembly 102 may also include hardware 114 (FIG. 1) that secures the first and second housing shells 106, 108 to each other. In the illustrated embodiment, the hardware 114 includes fasteners (e.g., screws), but other types of fasteners may be used in other embodiments. Alternative to or in addition to the hardware 114, an adhesive may be provided along the housing seam 116.

In an exemplary embodiment, the housing seam 116 is a single housing seam that extends continuously throughout the housing assembly 102 and splits to surround the electrical connector 104 and the loading passage 112. In other embodiments, the housing assembly 102 may include more than one housing seam. For example, in other embodiments, the housing assembly 102 may include more than two housing shells that are coupled to one another to form at least two housing seams.

When fully constructed as shown in FIGS. 1 and 2, the housing assembly 102 includes a mating side 120 and a loading side 122. The housing assembly 102 also includes first and second shell sides 126, 128 that are defined by the first and second housing shells 106, 108, respectively, in FIGS. 1 and 2. The housing assembly 102 also includes a back side 124 and a non-loading side 130. The back side 124 and the mating side 120 face in opposite directions along the Z-axis. The loading side 122 and the non-loading side 130 face in opposite direction along the X-axis. The first and second shell sides 126, 128 face in opposite directions along the Y-axis. In some embodiments, the mating side 120 may be secured to a panel 340 (shown in FIG. 12) using the hardware 138. The loading side 122 is referred to as the loading side because the loading passage 112 for receiving the insulated cables (not shown) is positioned along the loading side 122. In alternative embodiments, the loading passage 112 may be located along another side of the housing assembly 102. For example, the loading passage 112 may be positioned along the back side 124. In such embodiments, the loading side 122 may be referred to as an assembly side.

As shown, the electrical connector 104 includes a front end 132 that is presented along the mating side 120 for mating with an external mating connector (not shown). The front end 132 faces in a mating direction $M_1$ along the Z-axis. The electrical connector 104 includes a connector body or shroud 134 that clears and projects from the first and second housing shells 106, 108. A portion of the connector body 134 may be positioned within the interior cavity 125

Figure 10:
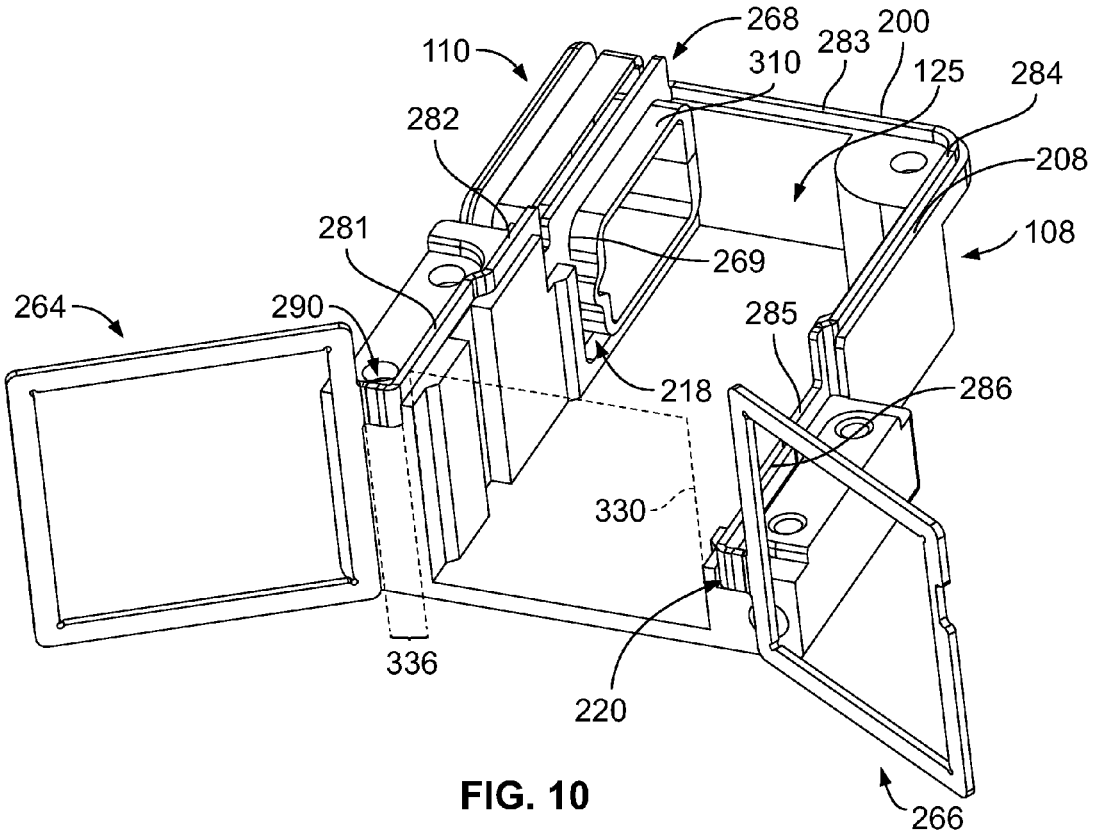
FIG. 10 is a front perspective view of a housing shell having the conductive gasket and the grommet coupled thereto.

(FIG. 10). In other embodiments, the front end 132 may be located a depth within the interior cavity 125. In such embodiments, the mating connector may be inserted into the interior cavity for mating with the electrical connector 104.

The first and second housing shells 106, 108 may include a conductive material. For example, the first and second housing shells 106, 108 may be die cast using a conductive material, such as a metal alloy. As another example, the first and second housing shells 106, 108 may be molded using a dielectric material having conductive elements or fillers. Alternatively, the first and second housing shells 106, 108 may include dielectric bodies that are plated with a conductive material.

In the illustrated embodiment, the electrical connector 104 includes respective contact sub-assemblies 136 that are configured to mate with corresponding contact sub-assemblies (not shown) of the mating connector (not shown). By way of example, the electrical connector 104 may be a STRADA Whisper connector, commercially available from TE Connectivity, Harrisburg, Pa. In an exemplary embodiment, the electrical connector 104 is a high speed differential pair cable connector that includes a plurality of differential pairs of conductors. The electrical connector 104 may be capable of transmitting at least about four (4) gigabits per second (Gbps), at least about 10 Gbps, at least about 20 Gbps, or at least about 40 Gbps. However, it should be understood that other types of electrical connectors may be held by the housing assembly 102.

Figure 3:
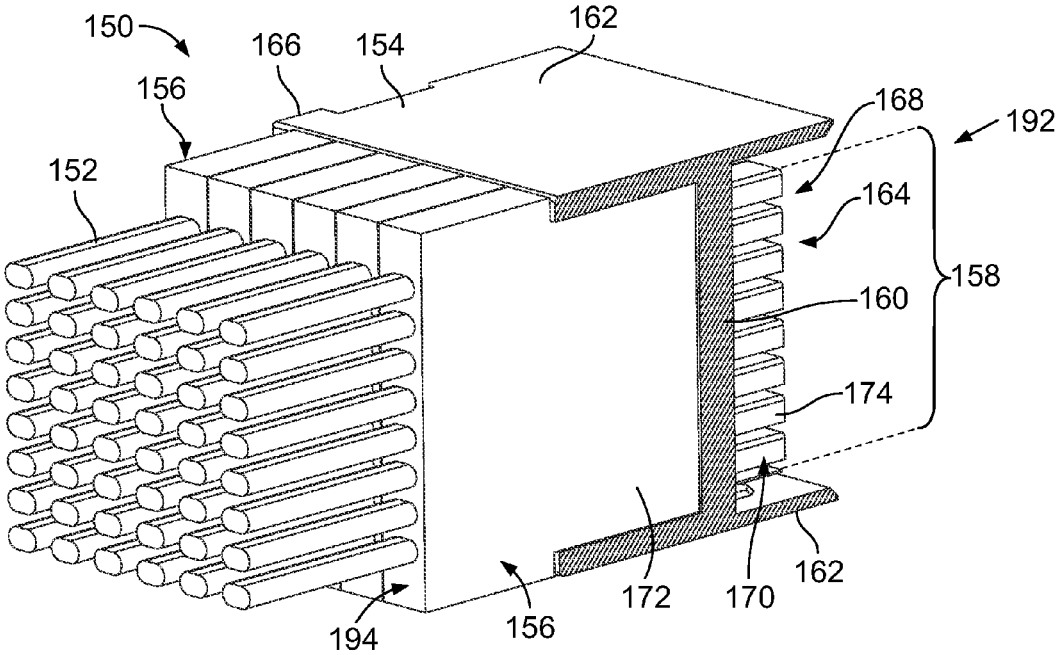
FIG. 3 is a side perspective view of an electrical connector that may be used with the electrical connector assembly of FIG. 1.
Figure 4:
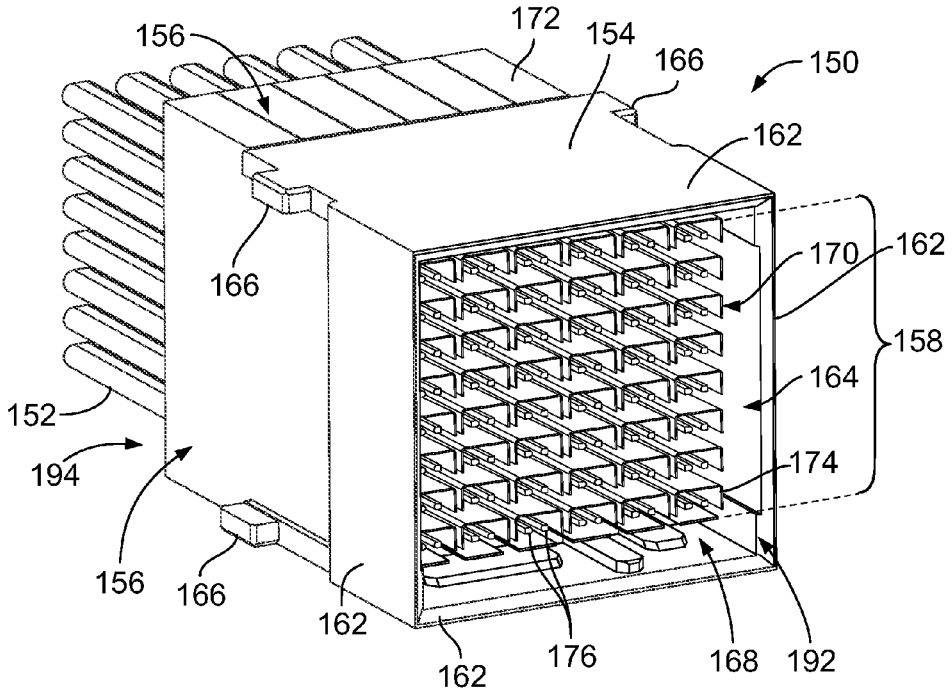
FIG. 4 is a front perspective view of the electrical connector of FIG. 3.

FIGS. 3 and 4 illustrate different perspective views of an electrical connector 150. The electrical connector 104 (FIG. 1) may be similar to the electrical connector 150. The electrical connector 150 has a front end 192 and a back end 194 that face in opposite directions. The electrical connector 150 is coupled to a plurality of individual insulated cables 152 in which each insulated cable 152 includes a pair of signal conductors and, optionally, at least one drain wire. The electrical connector 150 includes a connector body or housing 154 that holds a contact array 158 proximate to the front end 192. For instance, in the illustrated embodiment, the connector body 154 holds a plurality of contact modules 156. Each of the contact modules 156 forms a portion of the contact array 158 that is configured to engage a mating connector (not shown). The connector body 154 includes a base wall 160 (FIG. 3) and shroud walls 162 that extend from the base wall 160 to define a mating cavity or space 164 therebetween. The mating cavity 164 is configured to receive a portion of the mating connector (not shown) during a mating operation. The shroud walls 162 may guide mating of the mating connector with the electrical connector 150. In an exemplary embodiment, the connector body 154 has lugs 166 extending laterally outward from the shroud walls 162. The lugs 166 may be used to locate the electrical connector 150 with respect to the housing assembly, such as the housing assembly 102 (FIG. 1).

The contact array 158 includes electrical contacts 168 that may be arranged to form a plurality of contact sub-assemblies 170. Each of the contact modules 156 includes a plurality of contact sub-assemblies 170 and a support body 172 that holds the contact sub-assemblies 170 of the corresponding contact module 156. A plurality of contact sub-assemblies 170 of one contact module 156 may form a column (or row) of the contact array 158. The electrical contacts 168 of each contact sub-assembly 170 include a pair of signal contacts 176 (FIG. 4) and a ground contact (or ground shield) 174. Each of the signal contacts 176 may be terminated to a signal conductor (not shown) of a corresponding insulated cable 152. In an exemplary embodiment, the ground contact 174 peripherally surrounds the signal contacts 176 along a length of the signal contacts 176 to ensure that the signal paths are electrically shielded from interference.

The support body 172 provides support for the contact sub-assemblies 170. The insulated cables 152 extend into the corresponding support body 172 such that the support body 172 holds a portion of the insulated cables 152. The support body 172 may provide strain relief for the insulated cables 152. Optionally, the support body 172 may be manufactured from a plastic material. Alternatively, the support body 172 may be manufactured from a metal material. The support body 172 may be a metalized plastic material to provide additional shielding for the insulated cables 152 and the contact sub-assemblies 170. Optionally, the support body 172 may include a metal plate electrically connected to each ground contact 174 to electrically common each ground contact 174. The support body 172 may also include a dielectric material that is overmolded around the insulated cables 152 and portions of the metal plate to support the insulated cables 152 and the contact sub-assemblies 170.

In an exemplary embodiment, multiple contact modules 156 may be loaded into the connector body 154. The connector body 154 holds the contact modules 156 in parallel such that the contact sub-assemblies 170 are aligned in parallel columns. Any number of contact modules 156 may be held by the connector body 154 depending on the particular application. When the contact modules 156 are stacked in the connector body 154, the contact sub-assemblies 170 may also be aligned in rows.

Figure 5:
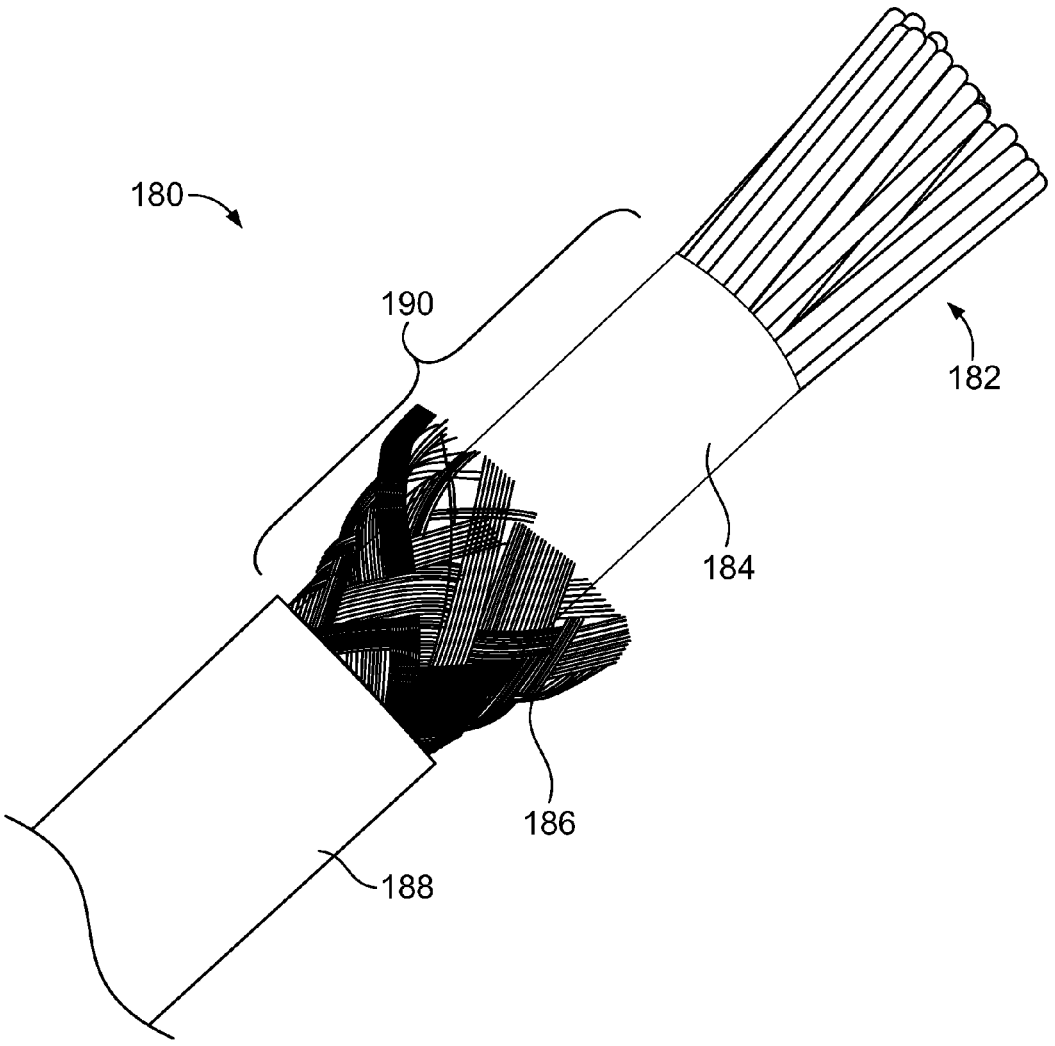
FIG. 5 illustrates an end of a cable harness that may be used with the electrical connector assembly of FIG. 1.

FIG. 5 is an image of an end of a cable harness 180, which may be incorporated with cable assemblies, such as the cable assembly 100 (FIG. 1). The cable harness 180 may include a plurality of insulated cables 182, a conductive foil 184 that surrounds the insulated cables 182, a conductive braid 186 that surrounds the conductive foil 184, and a protective jacket 188 that surrounds the conductive braid 186. In some embodiments, the conductive foil 184 and the conductive braid 186 may constitute a shielding layer 190 that is configured to shield the insulated cables 182 from EMI from adjacent cable harnesses (not shown). In other embodiments, the shielding layer 190 may include only the conductive foil 184 or only the conductive braid 186. Each of the insulated cables 182 may include a single insulated cable or multiple insulated cables.

In particular embodiments, the cable harness 180 has a length that is between about a half meter to about ten meters, but embodiments with other lengths are also possible. As described herein, the cable harness 180 may also be electrically coupled to or grounded to a housing assembly, such as the housing assembly 102 (FIG. 1). The cable harness 180 may also be referred to as a wire harness, a multicore cable, or multicore cabling.

In certain embodiments, the cable harness 180 is configured to have numerous insulated cables. For example, the cable harness 180 may include at least twenty-four (24) insulated cables. However, it should be understood that the cable harness 180 may include fewer than 24 insulated cables in some embodiments or more than 24 insulated cables in other embodiments.

Figure 6:
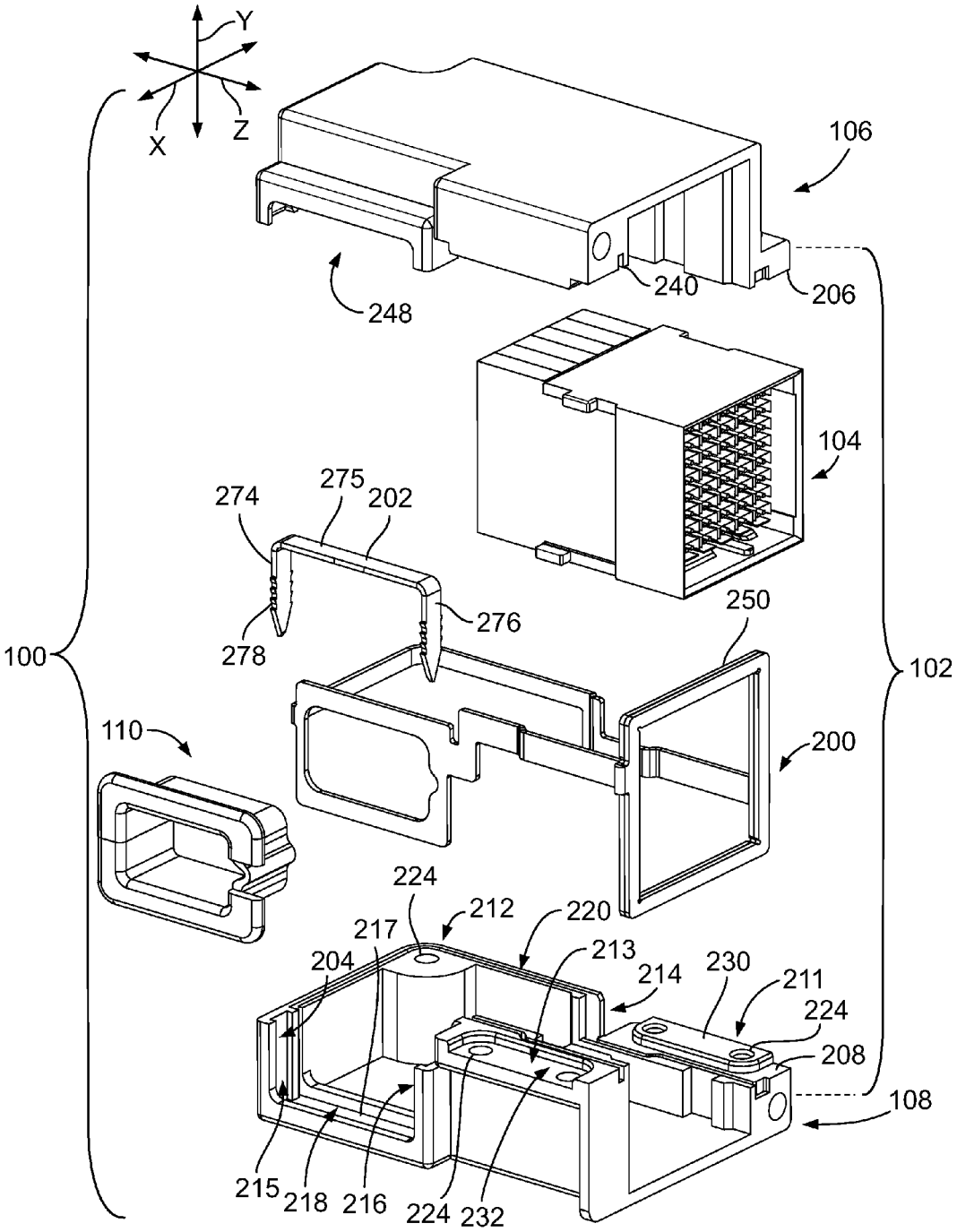
FIG. 6 is an exploded view of the electrical connector assembly of FIG. 1.

FIG. 6 is an exploded view of the cable assembly 100. Optionally, the cable assembly 100 may include a cable harness (not shown), such as the cable harnesses 180 and 406 (shown in FIGS. 5 and 14, respectively). The first housing shell 106 includes a shell edge 206, and the second housing shell 108 includes a shell edge 208. Each of the shell edges 206, 208 represents a portion of the respective housing shell that directly interfaces with another component of the cable assembly 100 to enclose the interior cavity 125 (FIG. 10) and form the housing seam 116 (FIG. 1) that extends along an exterior of the housing assembly 102. As used herein, an element may "directly interface" with another element if the two elements engage each other or face each other with a nominal gap therebetween. In an exemplary embodiment, the shell edge 206 is configured to directly interface with the shell edge 208 of the second housing shell 108 and the grommet 110. Likewise, the shell edge 208 is configured to directly interface with the shell edge 206 of the first housing shell 106 and the grommet 110. When the cable assembly 100 is fully assembled, the first and second housing shells 106, 108, the electrical connector 104, and the grommet 110 define the interior cavity 125 and form the housing seam 116.

Each of the shell edges 206, 208 may have a non-linear path and a surface with varying dimensions. For example, the shell edge 208 forms platform portions 211, 212, 213 that extend generally parallel to the XZ plane. Each of the platform portions 211-213 is separated from the other platform portions by a change in elevation of the shell edge 208 relative to the Y axis. More specifically, the platform portion 211 is separated from the platform portion 212 by an edge step 214. The platform portion 212 is separated from platform portion 213 by edge steps 215, 216. The edge steps 215, 216 are joined by an edge segment 217 and define a recess 218 therebetween. The recess 218 is sized and shaped to receive a portion of the grommet 110.

Although each of the platform portions 211-213 extends generally along the plane defined by the X and Z axes, the platform portions 211-213 may include non-planar features. For example, the shell edge 208 includes an open-sided channel 220 that extends through each of the platform portions 211-213. Optionally, the open-sided channel 220 may be formed through one or more of the edge steps 214-216. The platform portions 211-213 may include other non-planar features. For example, each of the platform portions 211-213 includes a thru-hole 224 that may receive corresponding hardware 114 (FIG. 1). The platform portion 211 includes a raised section 230, and the platform portion 213 includes a recessed section 232. The raised and recessed sections 230, 232 may be shaped to mate with corresponding features (not shown) along the shell edge 206.

The shell edge 206 may have similar features as the shell edge 208. For example, as shown in FIG. 6, the shell edge 206 may also include an open-sided channel 240 and a recess 248. In some embodiments, the open-sided channels 220, 240 align with each other when the first and second housing shells 106, 108 are coupled to each other. In some embodiments, the recesses 218, 248 may align with each other to form an opening that receives the grommet 110.

Also shown in FIG. 6, the cable assembly 100 includes a conductive gasket 200 and an optional shield fastener 202. The shield fastener 202 is sized and shaped to be inserted into a slot 204 formed by the second housing shell 108. The shield fastener 202 may engage and electrically couple to a portion of a shielding layer (not shown) of the cable harness (not shown). For example, the shield fastener 202 may engage a conductive braid (not shown) of the cable harness and electrically couple the conductive braid to the housing assembly 102. To this end, the shield fastener 202 may include opposite legs 274, 276 and a bridge 275 that joins the opposite legs 274, 276. The legs 274, 276 may include edge points 278 that are configured to engage the second housing shell 208 along the slot 204.

The conductive gasket 200 is configured to extend along the housing seam 116 (FIG. 1) when the first and second housing shells 106, 108 are coupled to each other. For example, one or more portions of the conductive gasket 200 may be disposed within the open-sided channel 220 and/or the open-sided channel 240. In other embodiments, however, the conductive gasket 200 may extend along the housing seam 116 without being positioned between the first and second housing shells 106, 108 As described herein, the conductive gasket 200 may form a 3D gasket frame 250 that substantially matches a 3D path of the housing seam 116 (FIG. 1).

Figure 7:
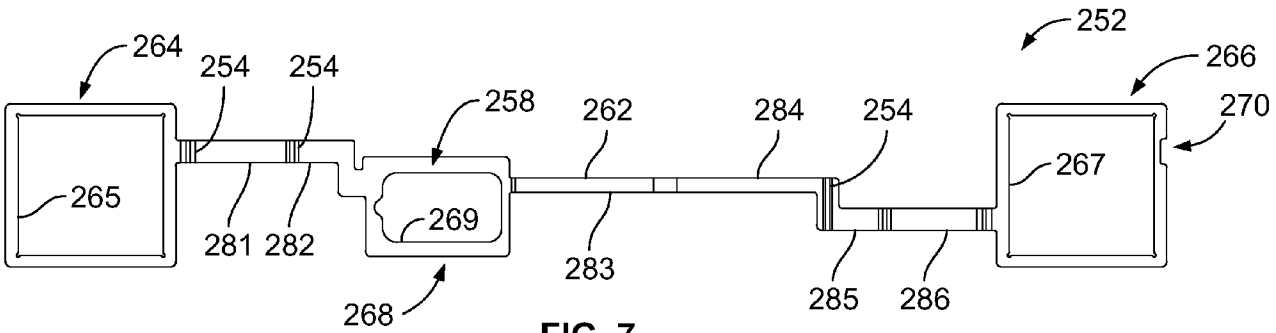
FIG. 7 is a plan view of a gasket blank in accordance with an embodiment that may be used to form a discrete conductive gasket.

FIG. 7 is a plan view of a gasket blank 252 that may be used to form the conductive gasket 200 (FIG. 6). In FIG. 7, the gasket blank 252 is planar. In some embodiments, the gasket blank 252 may be formed from a larger sheet of conductive material. For example, the gasket blank 252 may be stamped from conductive sheet metal or die cut from a sheet of conductive material. Alternatively, the gasket blank 252 may be injection molded or etched. The conductive material of the gasket blank 252 may be, for example, sheet metal or a dielectric material having conductive particles or fillers. In particular embodiments, the conductive material comprises a silicone or rubber material that is impregnated with conductive particles. In other embodiments, the gasket blank 252 may comprise a rigid core (e.g., formed from sheet metal) that is surrounded by a semi-rigid material, such as a conductive foam or the dielectric material having conductive particles. The gasket blank 252 may be rigid or semi-rigid, but capable of being bent or otherwise shaped to form the conductive gasket 200. In some embodiments, the gasket blank 252 may include folding features 254, such as indentations or creases, that facilitate shaping the gasket blank 252 into the 3D gasket frame 250 (FIG. 6). In other embodiments, the gasket blank 252 does not include fold features.

The gasket blank 252 has a first blank side 258, a second blank side 260 (shown in FIG. 8), and an outer blank edge 262 that extends therebetween. In the illustrated embodiment, the gasket blank 252 forms a first connector loop 264 and a second connector loop 266. The gasket blank 252 may also form a cable loop 268. The first connector loop 264, the second connector loop 266, and the cable loop 268 are defined by inner loop edges 265, 267, 269, respectively. The inner loop edge 269 is sized and shaped to directly interface with the grommet 110 (FIG. 1). The inner loop edges 265, 267 may be sized and shaped to directly interface with the electrical connector 104. As shown, the second connector loop 266 may also include a notch 270.

In the illustrated embodiment, each of the first connector loop 264, the second connector loop 266, and the cable loop 268 are continuous or unbroken. In other embodiments, one or more of the first connector loop 264, the second connector loop 266, and the cable loop 268 may have a break. For example, a gap along the cable loop 268 may be provided to allow a plurality of insulated cables to be inserted therein. The gasket blank 252 also includes a plurality of gasket segments 281-286, which are described in greater detail below.

Although the gasket blank 252 is capable of being shaped in some embodiments, the gasket blank 252 and resulting conductive gasket 200 (FIG. 6) are discrete structures having substantially fixed shapes. Unlike rope-like gasket material, the gasket blank 252 and the conductive gasket 200 may have a rigid or semi-rigid quality such that the shapes of the gasket blank 252 and the conductive gasket 200 are maintained prior to assembly with the other components of the housing assembly 102 (FIG. 1). For example, the conductive gasket 200 may have a substantially fixed structure as the conductive gasket 200 is coupled to the second housing shell 108 (FIG. 1).

Figure 8:
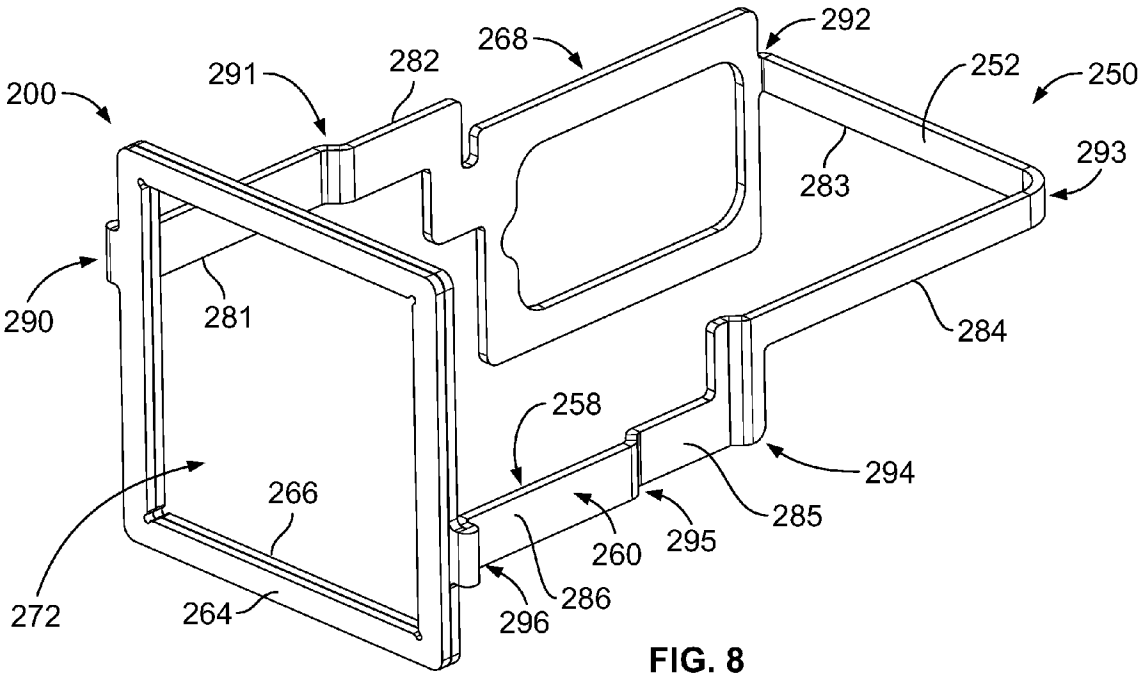
FIG. 8 illustrates the conductive gasket after the gasket blank is folded or shaped.

FIG. 8 illustrates the conductive gasket 200 after the gasket blank 252 is folded or shaped. The gasket blank 252 may have a substantially uniform thickness 360 (shown in FIG. 13) between the first blank side 258 and the second blank side 260. In alternative embodiments, however, the gasket blank 252 may have a non-uniform thickness. The gasket segments 281-286 may be elongated links of the 3D gasket frame 250 that extend between folded or bent portions of the gasket blank 252 and/or loops of the gasket blank 252. For example, in the illustrated embodiment, the gasket segment 281 extends between a flex portion 290 and a folded portion 291. The flex portion 290 may represent a hinge for the first connector loop 264. The gasket segment 282 extends between the folded portion 291 and the cable loop 268. The gasket segment 282 is substantially L-shaped.

The 3D gasket frame 250 may also include a folded portion 292 adjacent to the cable loop 268. The folded portion 292 may represent a back corner of the 3D gasket frame 250. The gasket segment 283 extends between the folded portion 292 and a folded portion 293, which may also represent a back corner of the 3D gasket frame 250. The gasket segment 284 extends between the folded portion 293 and a folded portion 294. The gasket segment 285 extends between the folded portion 294 and a folded portion 295. The gasket segment 285 is also substantially L-shaped. The gasket segment 286 extends between the folded portion 295 and a flex portion 296. The flex portion 296 may represent a hinge for the second connector loop 266.

The first and second connector loops 264, 266 are overlapped such that the first blank side 258 along the first connector loop 264 engages the second blank side 260 along the second connector loop 266. The first and second connector loops 264, 266 define a connector-receiving window 272. In alternative embodiments, the gasket blank 252 may include only one connector loop that forms the connector-receiving window 272.

As shown, the gasket segments 281-286, the first and second connector loops 264, 266, and the cable loop 268 have different orientations in 3D space. For example, the first and second connector loops 264, 266 and the gasket segment 283 extend generally parallel to the XY plane. Moreover, the gasket segments 281, 282, 284, 285, and 286 and the cable loop 268 extend generally parallel to the YZ plane. The 3D gasket frame 250 is configured to surround the interior cavity 125 (FIG. 10). In some embodiments, the 3D gasket frame 250 may define a 3D space that is substantially equal to or greater than the interior cavity 125.

Figure 9:
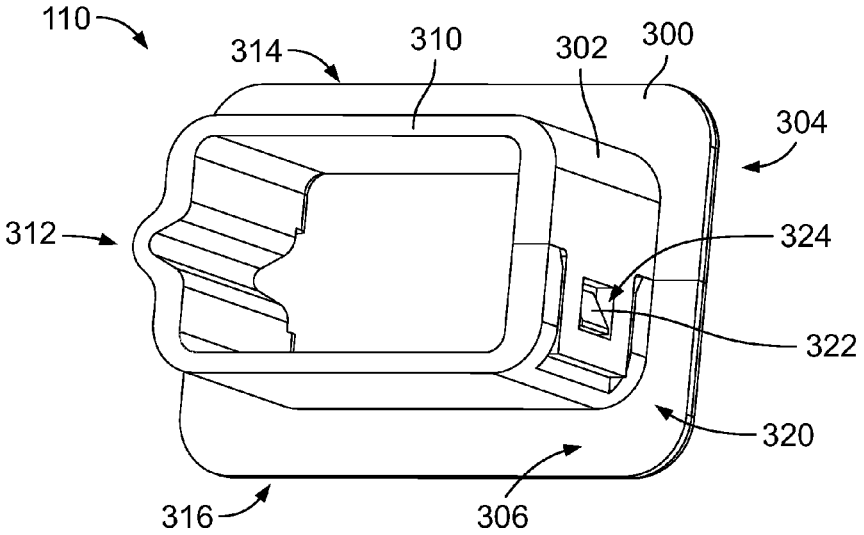
FIG. 9 is an isolated perspective view of a grommet that may be used by the electrical connector assembly of FIG. 1.

FIG. 9 is an isolated perspective view of the grommet 110. The grommet 110 may comprise a dielectric material that is, optionally, impregnated with conductive particles. The grommet 110 includes a flange portion 300 and a clamp portion 302 that are coupled to each other. The flange portion 300 extends radially away from the clamp portion 302. As shown, the flange portion 300 has an outer side 304 and an inner side 306 that face in opposite directions. The inner side 306 may engage the first and second housing shells 106, 108 (FIG. 1). The outer side 304 may form a portion of an exterior of the housing assembly 102 (FIG. 1). The clamp portion 302 includes a clamp wall 310 that is configured to surround and engage the conductive braid and protective jacket (not shown).

In some embodiments, the grommet 110 may have first and second grommet legs 314, 316 and a grommet hinge 312 that joins the first and second grommet legs 314, 316. Each of the first and second grommet legs 314, 316 includes a section of the clamp portion 302 and a section of the flange portion 300. The grommet hinge 312 permits the first and second grommet legs 314, 316 to move away from each other and thereby open the grommet 110 for receiving the cable harness. As shown, the first and second grommet legs 314, 316 may form a coupling mechanism 320 for securing the first and second grommet legs 314, 316 to each other. In the illustrated embodiment, the coupling mechanism 320 is a latching mechanism that includes a latch 322 of the second grommet leg 316 and a latch opening 324 of the first grommet leg 314 that is sized and shaped to receive the latch 322.

FIG. 10 is a front perspective view of the second housing shell 108 coupled to the conductive gasket 200 and the grommet 110. FIG. 10 shows a majority of the interior cavity 125. The interior cavity 125 is sized and shaped to receive at least a portion of the electrical connector 104 (FIG. 1) and, in an exemplary embodiment, a plurality of insulated cables (not shown) that couple to the electrical connector 104 within the interior cavity 125.

In some embodiments, the cable assembly 100 (FIG. 1) may be assembled by securing the grommet 110 around a cable harness (not shown) or a bundle of the insulated cables and inserting the grommet 110 with the insulated cables through the cable loop 268 of the conductive gasket 200 such that the inner loop edge 269 directly interfaces with the grommet 110 or, more specifically, the clamp wall 310. In such embodiments, the conductive gasket 200, the grommet 110, and the cable harness may be simultaneously coupled to the second housing shell 108. The conductive gasket 200 may be positioned along the shell edge 208 and the grommet 110 may be positioned within the recess 218.

In some embodiments, the open-sided channel 220 is configured to allow the conductive gasket 200 to be positioned, as a discrete structure having a fixed shape, into the open-sided channel 220 from above the second housing shell 208. In particular embodiments, the gasket segments 281-286 and the cable loop 268 may simultaneously enter the open-sided channel 220. As shown, the conductive gasket 200 is positioned only partially within the open-sided channel 220 of the shell edge 208 such that a portion of the conductive gasket 200 is disposed within the open-sided channel 220 and a portion of the conductive gasket 200 protrudes from the open-sided channel 220.

As shown in FIG. 10, the first and second connector loops 264, 266 are in open positions. The second housing shell 108 defines a portion of a connector opening 330 (indicated by a dashed box) that is located through the mating side 120 (FIG. 1). A remaining portion of the connector opening 330 may be defined by the first housing shell 106 (FIG. 1). With the first and second connector loops 264, 266 in the open positions, a back end (not shown) of the electrical connector 104 (FIG. 1) may be inserted through the connector opening 330 and loaded into the interior cavity 125. In some embodiments, the electrical connector 104 may also be lowered into the second housing shell 108. Before the electrical connector 104 is loaded into the interior cavity 125, the insulated cables may be terminated to the electrical connector 104. Alternatively, the insulated cables may be terminated to the electrical connector after the electrical connector 104 has been loaded into the interior cavity 125.

Figure 11:
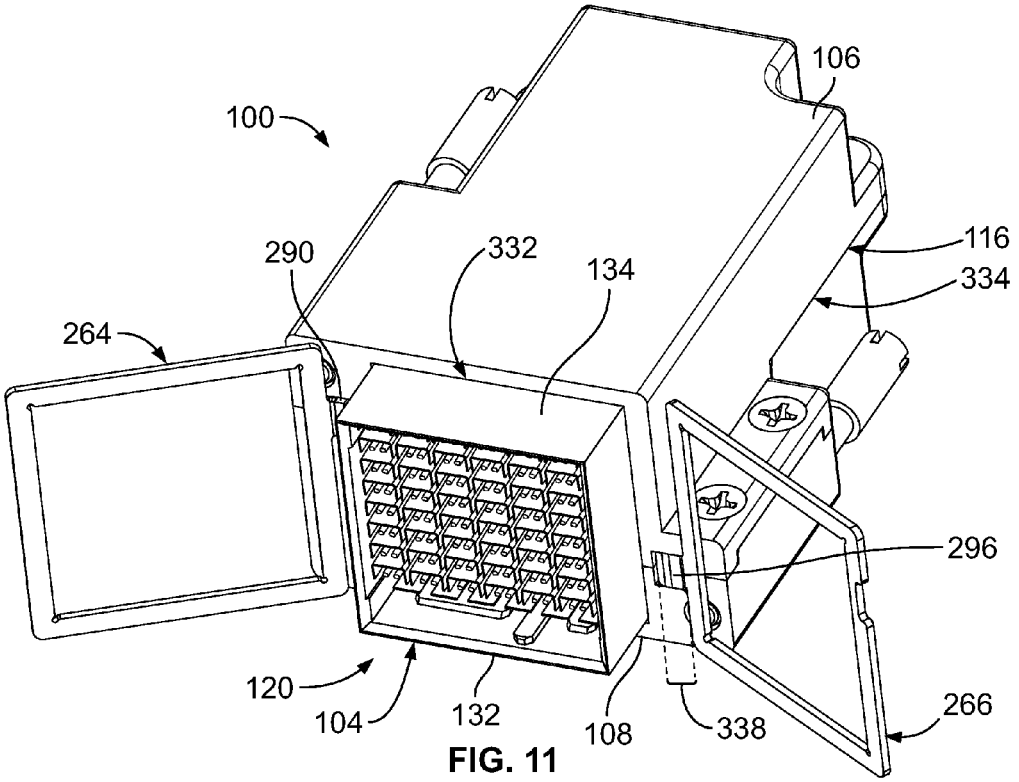
FIG. 11 is a front perspective view of the electrical connector assembly prior to two connector loops of the conductive gasket being positioned around the electrical connector.

FIG. 11 is a front perspective view of the cable assembly 100 before the first and second connector loops 264, 266 are positioned to surround the electrical connector 104. After the electrical connector 104 is terminated to the insulated cables (not shown) and positioned within the interior cavity 125 (FIG. 10), the first housing shell 106 may be coupled to the second housing shell 108. As shown, the housing seam 116 includes a connector path portion 332 and a housing path portion 334. The housing path portion 334 is defined between the first and second housing shells 106, 108. The connector path portion 332, however, surrounds the electrical connector 104 or, in particular, the connector body 134 of the electrical connector 104. More specifically, a segment of the connector path portion 332 is defined between the first housing shell 106 and the electrical connector 104 and another segment of the connector path portion 332 is defined between the second housing shell 108 and the electrical connector 104. The first and second connector loops 264, 266 are configured to extend along the connector path portion 332 of the housing seam 116 to reduce EMI leakage therethrough.

The flex portion 290 has a length 336 (shown in FIG. 10), and the flex portion 296 has a length 338. The flex portions 290, 296 may be positioned to extend away from the mating side 120. The lengths 336, 338 permit the first and second connector loops 264, 266, respectively, to be positioned in front of the front end 132 and then over the connector body 134 such that the electrical connector 104 extends through the first and second connector loops 264, 266. The flex portions 290, 296 provide hinges that allow the first and second connector loops 264, 266 to pivot and be folded against each other and against the mating side 120. The connector body 134 of the electrical connector 104 extends through the connector-receiving window 272 (FIG. 8). After the first and second connector loops 264, 266 are operably positioned, the cable assembly 100 may appear as shown in FIGS. 1 and 2.

Figure 12:
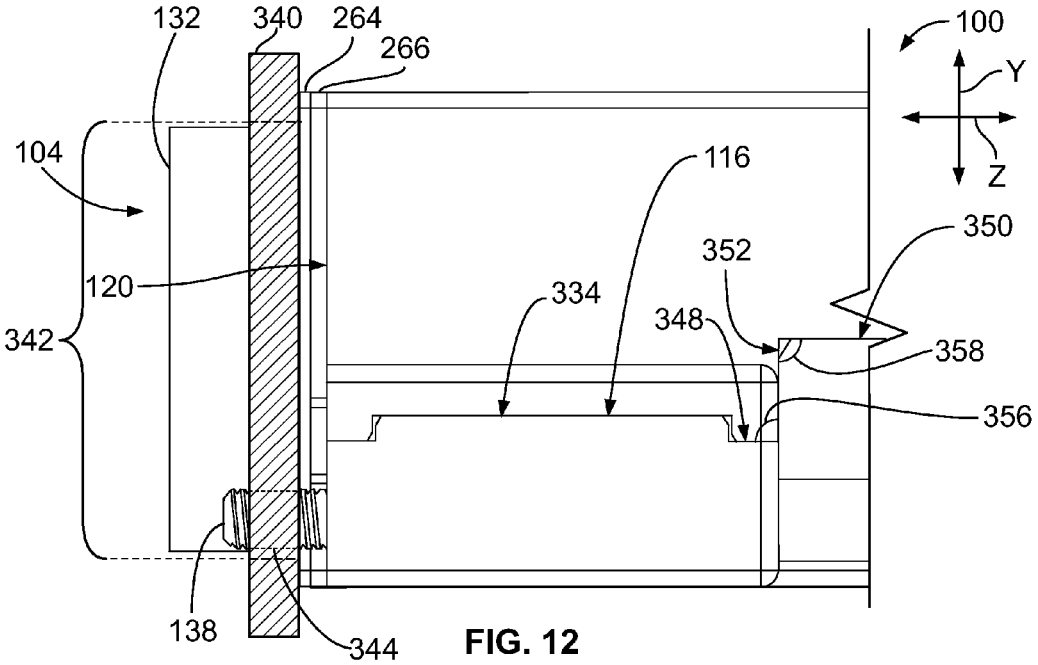
FIG. 12 is a side view of the electrical connector assembly mounted to a panel of a communication system.

FIG. 12 is a side view of the cable assembly 100 mounted to a panel 340 of a communication system (not shown). The panel 340 includes a panel window 342 (indicated by dashed lines through the panel 340) that is sized and shaped to permit the front end 132 to be advanced through the panel window 342. As shown, the hardware 138 may extend through a fastener hole 344 and secure the cable assembly 100 to the panel 340. The first and second connector loops 264, 266 may be compressed between the mating side 120 and the panel 340.

Also shown in FIG. 12, the housing path portion 334 of the housing seam 116 may form first and second linear portions 348, 350 that have different elevations relative to the Y-axis. The first and second linear portions 348, 350 extend parallel to the Z-axis. The housing path portion 334 also includes a step portion 352. The step portion 352 extends parallel to the Y-axis and joins the first and second linear portions 348, 350. In other words, the step portion 352 forms an angle 356 with respect to the first linear portion 348 that is about 90°. The step portion 352 also forms an angle 358 with respect to the second linear portion 350. The angle 358 is 90° in the illustrated embodiment. In other embodiments, however, the angles 356, 358 may be less than or greater than 90°. For example, the angles 356, 358 may be between 60° and 120° or, more specifically, 70° and 110°.

Housing seams that include abrupt changes in path direction, such as the step portion 352, may be susceptible to EMI leakage. It may be difficult to reliably position conventional gaskets along housing seams that include abrupt changes in path direction. Embodiments set forth herein are configured to reduce EMI leakage for 3D paths that include such abrupt changes in path direction. More specifically, the conductive gasket 200 is a discrete body that may be shaped to substantially match the 3D path of the housing seam 116. In some embodiments, the conductive gasket 200 may be easier to position along the housing seam 116 than conventional gaskets.

Figure 13:
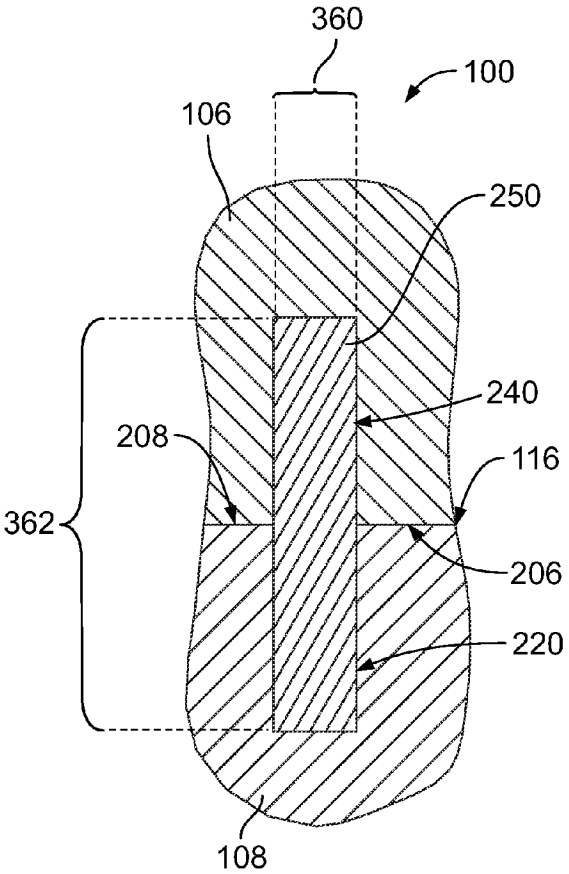
FIG. 13 is a cross-section of the electrical connector assembly illustrating the conductive gasket disposed between two housing shells of the electrical connector assembly.

FIG. 13 is a cross-section of the cable assembly 100 that illustrates the housing seam 116 in greater detail. As shown, the 3D gasket frame 250 has a thickness 360 and a height 362. In some embodiments, the height 362 is at least two times (2×) or at least three times (3×) the thickness 360. About half of the height 362 is located within the open-sided channel 220 of the shell edge 208, and about half of the height 362 is located within the open-sided channel 240 of the shell edge 206. As such, the 3D gasket frame 250 may block any inadvertent gaps along the housing seam 116 and thereby reduce EMI leakage.

As described above, in some embodiments, the second housing shell 108 may have the 3D gasket frame 250 disposed within the open-sided channel 220 prior to the first and second housing shells 106, 108 being coupled to each other. As the first housing shell 106 is mounted onto the second housing shell 108, the 3D gasket frame 250 may be received within the open-sided channel 240 of the first housing shell 106. In particular embodiments, the 3D gasket frame 250 may be semi-rigid such that the 3D gasket frame 250 is partially compressed by the first and second housing shells 106, 108. In such embodiments, the semi-rigid material may facilitate establishing multiple contact points between the 3D gasket frame 250 and the first and second housing shells 106, 108.

In alternative embodiments, however, the 3D gasket frame 250 may have rigid construction. For example, the 3D gasket frame 250 may be stamped and formed from sheet metal. In such embodiments, the first and second housing shells 106, 108 may optionally include spring fingers that engage the 3D gasket frame 250.

Figure 14:
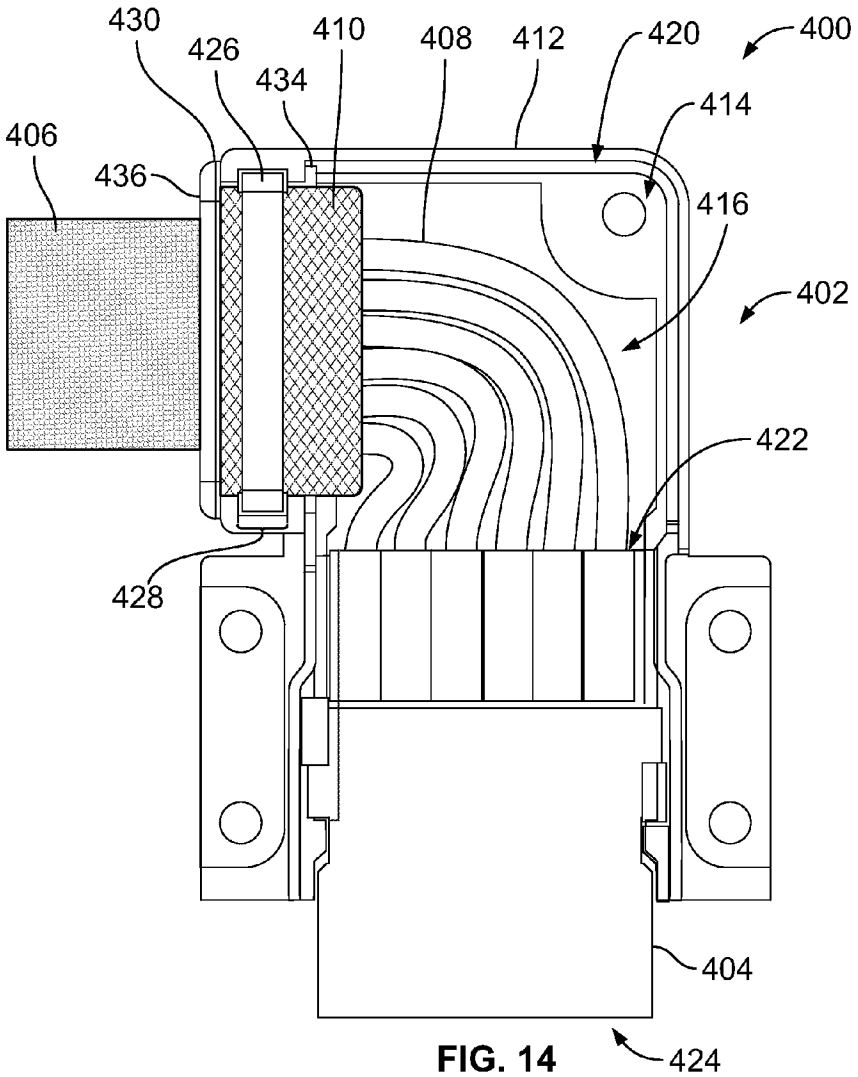
FIG. 14 is an image of a portion of a cable assembly formed in accordance with an embodiment.

FIG. 14 is an image of a portion of a cable assembly 400 formed in accordance with an embodiment. The cable assembly 400 may have similar features as the cable assembly 100 (FIG. 1). For example, the cable assembly 400 includes a housing assembly 402, an electrical connector 404 that is held by the housing assembly 402, and a cable harness 406 having a plurality of insulated cables 408 and a conductive braid 410 that surround the insulated cables 408. In FIG. 14, only one housing shell 412 of the housing assembly 402 is shown, but the housing assembly 402 may include another housing shell that couples to the housing shell 412. The housing shell 412 includes a shell edge 414 that defines an interior cavity 416 of the housing assembly 402. The shell edge 414 includes an open-sided channel 420. Although not shown in FIG. 14, the open-sided channel 420 is configured to receive a conductive gasket, such as the conductive gasket 200 (FIG. 6).

The cable assembly 400 also includes a grommet 430 that defines a loading passage (not shown) that provides access to the interior cavity 416. In FIG. 14, the cable harness 406 extends through the loading passage into the interior cavity 416. Similar to the second housing shell 108 (FIG. 1), the housing shell 412 is shaped to receive and hold the grommet 430. As shown, an inner flange portion 434 of the grommet 430 is disposed within the interior cavity 416 and an outer flange portion 436 extends along an exterior of the housing shell 412. The inner and outer flange portions 434, 436 may secure the grommet 430 to the housing shell 412. The grommet 430 may be similar or identical to the grommet 500 (shown in FIG. 15) such that the inner flange portion 434 includes one or more ears.

The electrical connector 404 includes a back end 422 and a front end 424 that face in opposite directions. The back end 422 is positioned within the interior cavity 416 and is mechanically and electrically coupled to the insulated cables 408 of the cable harness 406. Also shown in FIG. 14, the cable assembly 400 includes a shield fastener 426 that is positioned within a slot 428 formed by the housing shell 412. The shield fastener 426 engages the conductive braid 410 and secures the conductive braid 410 to the housing assembly 402. The conductive braid 410 is folded around a portion of the grommet 430. As such, the conductive braid 410 may be electrically coupled to the housing assembly 402.

Figure 16:
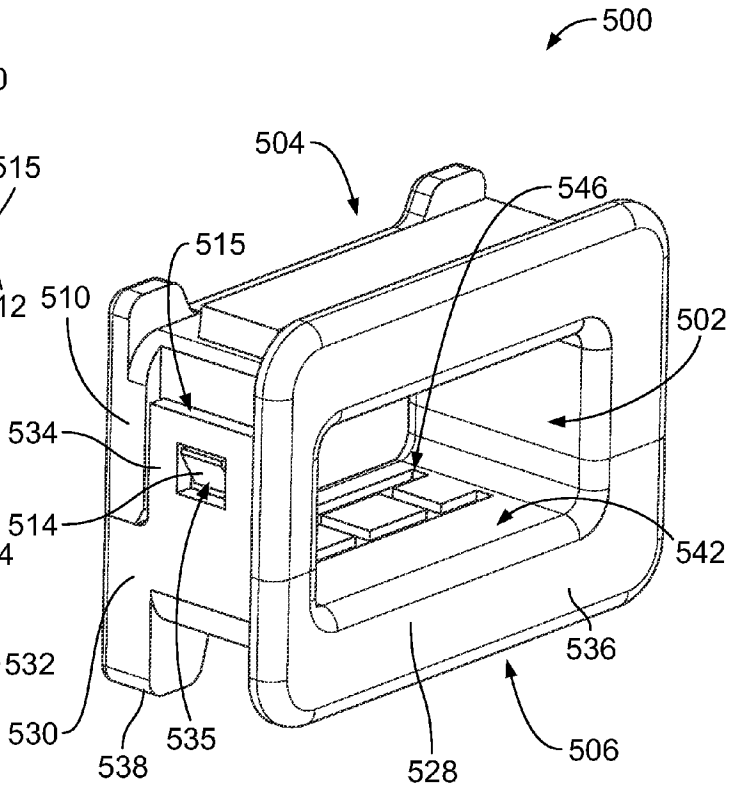
FIG. 16 is an isolated perspective view of the grommet of FIG. 16 after two grommet sections have been coupled to each other to form the grommet.
Figure 15:
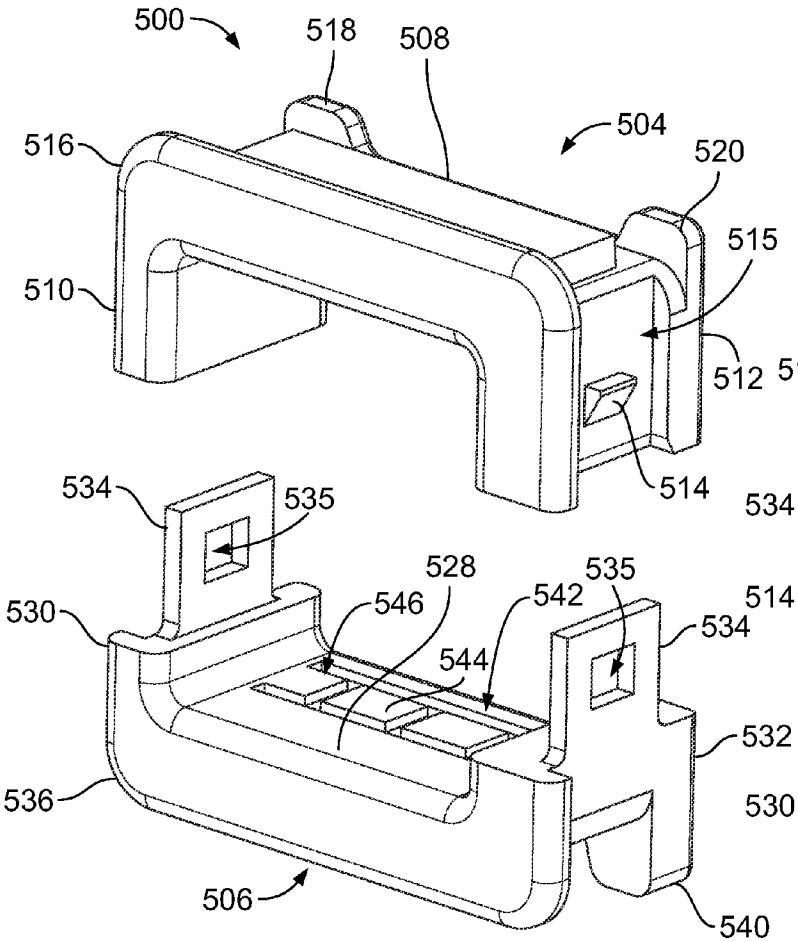
FIG. 15 is an exploded view of a grommet formed in accordance with an embodiment.

FIG. 15 is an exploded view of a grommet 500 in accordance with an embodiment, and FIG. 16 is an isolated perspective view of the grommet 500. The grommet 500 may be similar to the grommet 110 (FIG. 9) and the grommet 430 (FIG. 14). For example, the grommet 500 is configured to secure a cable harness (not shown) to a housing assembly (not shown) and may comprise a dielectric material that is, optionally, impregnated with conductive particles. The grommet 500 defines a loading passage 502 (FIG. 16) that receives the cable harness (not shown).

With respect to FIG. 15, the grommet 500 includes a first grommet section 504 and a second grommet section 506 that are configured to be coupled to each other. The first grommet section 504 includes a section bridge 508 and first and second section legs 510, 512. In an exemplary embodiment, each of the first and second section legs 510, 512 includes a latch projection 514 that is positioned within a wall-receiving track 515 defined by the corresponding section leg. Also shown, the first grommet section 504 forms a flange segment 516 and first and second ears 518, 520. The first and second ears 518, 520 are separated by a gap. The flange segment 516 is configured to be disposed in an exterior of the housing assembly, and the first and second ears 518, 520 are configured to be disposed in an interior cavity (not shown) of the housing assembly.

The second grommet section 506 also includes a section bridge 528 and first and second section legs 530, 532. In an exemplary embodiment, each of the first and second section legs 530, 532 includes a latch wall 534. The latch walls 534 include corresponding windows or openings 535. Similar to the first grommet section 504, the second grommet section 506 forms a flange segment 536 and a first ear 538 (shown in FIG. 16) and a second ear 540. The first and second ears 538, 540 are also separated by a gap. Also shown, the bridge member 528 include an inner surface 542 that forms a plurality of platforms 544 that are surrounded by recesses 546.

FIG. 16 illustrates the fully constructed grommet 500 after the first and second grommet sections 504, 506 have been coupled to each other. The loading passage 502 is defined by the first and second grommet sections 504, 506. As shown, the latch wall 534 of the first section leg 530 of the second grommet section 506 is positioned within the wall track 515 of the first section leg 510 of the first grommet section 504. The latch projection 514 is positioned within the window 535. The wall tracks 515 and the latch projections 514 form coupling mechanisms that secure the first and second grommet sections 504, 506 to each other.

During assembly of a cable assembly (not shown), a cable harness (not shown) may be positioned between the latch walls 534 of the second grommet section 506 and along the inner surface 542 of the section bridge 528. The cable harness may include a shielding layer (e.g., conductive braid) that is folded over a portion of the second grommet section 506 such that the shielding layer is positioned between the first and second ears 538, 540. The second grommet section 506 may be positioned within a recess (not shown) of a corresponding housing shell (not shown). The flange segment 536 and the first and second ears 538, 540 (FIG. 15) may secure the second grommet section 506 to the housing shell. Optionally, an adhesive may be provided within the recesses 546 that facilitates securing the cable harness to the second grommet section 506. The first grommet section 504 may be secured to the second grommet section 506 with the cable harness therebetween. Although the above description was with specific reference to the second grommet section 506 first receiving the cable harness, in other embodiments, the first grommet section 504 may first receive the cable harness.

Figure 19:
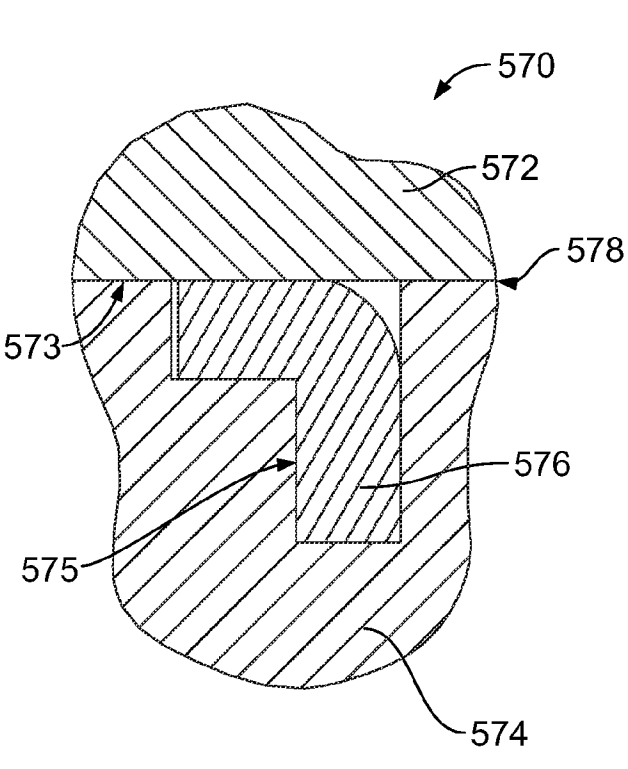
FIG. 19 is a cross-section of an electrical connector assembly formed in accordance with an embodiment illustrating a conductive gasket disposed between two housing shells of the electrical connector assembly.
Figure 18:
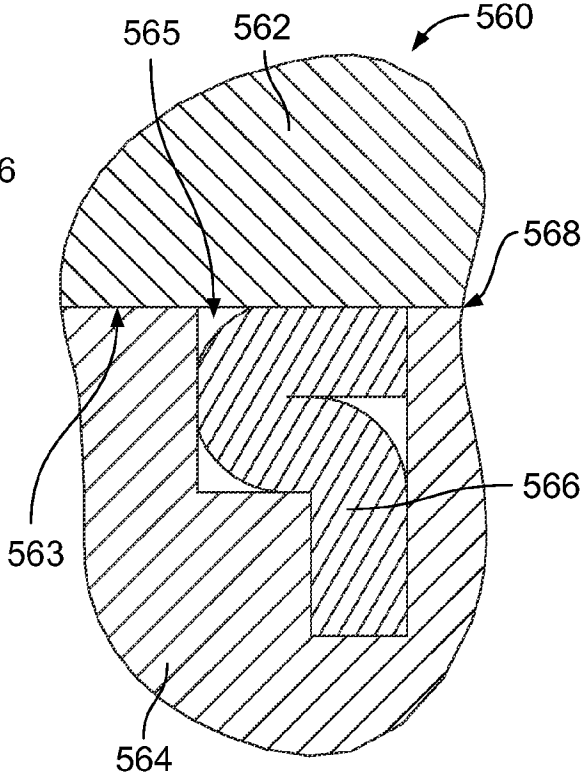
FIG. 18 is a cross-section of an electrical connector assembly formed in accordance with an embodiment illustrating a conductive gasket disposed between two housing shells of the electrical connector assembly.
Figure 17:
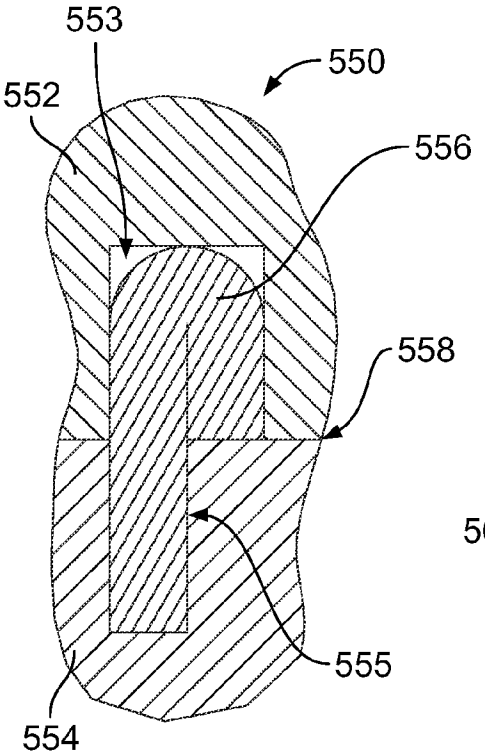
FIG. 17 is a cross-section of an electrical connector assembly formed in accordance with an embodiment illustrating a conductive gasket disposed between two housing shells of the electrical connector assembly.

FIGS. 17-19 are cross-sections of different cable assemblies 550, 560, 570, respectively. With respect to FIG. 17, the cable assembly 550 includes first and second housing shells 552, 554 that include respective open-sided channels 553, 555. The first and second housing shells 552, 554 engage each other along a housing seam 558. The cable assembly 550 also includes a conductive gasket 556 that is positioned between the first and second housing shells 552, 554 within the open-sided channels 553, 555. The open-sided channels 553, 555 are dimensioned differently such that the open-sided channel 553 is wider than the open-sided channel 555.

Embodiments set forth herein may include conductive gaskets that are capable of being folded within one or more of the open-sided channels. Conductive gaskets that are capable of being folded within the open-sided channel(s) may facilitate manufacturing the cable assembly and/or increase the number of contact points between the conductive gasket and the housing shell(s). For example, in the illustrated embodiment, the conductive gasket 556 is folded onto itself within the open-sided channel 553. The conductive gasket 556 is not folded within the open-sided channel 555.

In FIG. 18, the cable assembly 560 includes first and second housing shells 562, 564 that engage each other along a housing seam 568. As shown, the second housing shell 564 includes an open-sided channel 565. The first housing shell 562, however, is devoid of an open-sided channel along the housing seam 568 at the cross-section shown in FIG. 18. Instead, the first housing shell 562 includes a planar surface 563 that spans or extends over the open-sided channel 565. As shown, a conductive gasket 566 is folded within the open-sided channel 565 and onto itself. The conductive gasket 566 engages the second housing shell 564 within the open-sided channel 565 and engages the first housing shell 562 along the planar surface 563.

In FIG. 19, the cable assembly 570 includes first and second housing shells 572, 574 that engage each other along a housing seam 578. As shown, the second housing shell 574 includes an open-sided channel 575. The first housing shell 572, however, is devoid of an open-sided channel along the housing seam 578 at the cross-section shown in FIG. 19. Instead, the first housing shell 572 includes a planar surface 573 that spans or extends over the open-sided channel 575. As shown, a conductive gasket 576 is folded within the open-sided channel 575. The conductive gasket 576 engages the second housing shell 574 within the open-sided channel 575 and engages the first housing shell 572 along the planar surface 573. Unlike the conductive gasket 566, the conductive gasket 576 is not folded onto itself.

Although FIGS. 17-19 have been described as showing housing seams of different cable assemblies, it should be understood that a single cable assembly may have a housing seam having different portions that are similar to the housing seams shown in FIGS. 17-19. For example, in some embodiments, a single housing seam may include a first portion that is similar to the housing seam 578 (FIG. 19) and a second portion that is similar to the housing seam 568 (FIG. 18) or the housing seam 558 (FIG. 17). In some embodiments, neither of the first and second housing shells may include an open-sided channel for at least a portion of the housing seam. For instance, in such embodiments, the conductive gasket may be compressed between two planar surfaces of the first and second housing shells.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a housing assembly having first and second housing shells that are coupled to each other and define an interior cavity therebetween, the first and second housing shells having respective shell edges that directly interface each other along a housing seam, the housing seam extending along a three-dimensional (3D) path between the respective shell edges of the first and second housing shells;

an electrical connector having a back end that is disposed within the interior cavity and a front end that is configured to mate with an external mating connector; and a conductive gasket having a 3D gasket frame that substantially matches the 3D path of the housing seam between the respective shell edges of the first and second housing shells, the 3D gasket frame being a discrete structure that is positioned along the housing seam to reduce electromagnetic interference (EMI) leakage through the housing seam.

2. The electrical connector assembly of claim 1, wherein the conductive gasket is stamped or cut from a sheet of conductive material and shaped to form the 3D gasket frame, the conductive gasket having a cross-section taken transverse to a path of the housing seam, the cross-section including a height and a thickness, the thickness being defined between two opposite sides of the sheet of conductive material, the height being measured perpendicular to the thickness between two opposite edges of the conductive gasket, the thickness being at least three times the thickness for a majority of the path of the housing seam.

3. The electrical connector assembly of claim 1, wherein the electrical connector assembly is oriented relative to mutually perpendicular X, Y, and Z axes, the front end facing in a mating direction along the Z-axis, the 3D gasket frame including one or more segments that extend generally along a plane defined by the X and Y axes and one or more segments that extend generally along a plane defined by the Y and Z axes.

4. The electrical connector assembly of claim 1, wherein the housing assembly includes a loading passage that provides access to the interior cavity, the electrical connector assembly further comprising a cable harness that is coupled to the housing assembly, the cable harness including a bundle of insulated cables that extend through the loading passage, the conductive gasket forming a loop that surrounds the bundle of the insulated cables.

5. The electrical connector assembly of claim 1, wherein the electrical connector is configured to transmit data signals at a data rate of at least 10 gigabits per second.

6. The electrical connector assembly of claim 1, wherein the electrical connector includes a contact array comprising a plurality of contact sub-assemblies, each contact sub-assembly including a pair of signal contacts and a ground contact that surrounds the pair of signal contacts.

7. The electrical connector assembly of claim 1, wherein the electrical connector assembly is oriented relative to mutually perpendicular X, Y, and Z axes, the conductive gasket being stamped or cut from a sheet of conductive material to provide a blank that is defined by a blank edge, the blank edge being shaped to change a direction of a gasket path of the conductive gasket relative to the Y axis, the blank being folded to change a direction of the gasket path along the XZ plane.

8. The electrical connector assembly of claim 7, wherein the housing seam includes a linear portion and a step portion that are defined by the respective shell edges of the first and second housing shells along a same side of the housing assembly, the linear portion and the step portion forming an angle with respect to each other that is between 70° and 110°, the step portion extending along the Y axis, the conductive gasket extending along the linear and step portions.

9. The electrical connector assembly of claim 7, wherein the first housing shell and the second housing shell include first and second open-sided channels, respectively, a portion of the conductive gasket extending into and being partially compressed within the first open-sided channel and a portion of the conductive gasket extending into and being partially compressed within the second open-sided channel.

10. The electrical connector assembly of claim 7, wherein the conductive gasket has pre-formed folding features that include at least one of indentations or creases, the conductive gasket being folded at the folding features.

11. The electrical connector assembly of claim 1, wherein the housing seam includes a housing path portion defined by the respective shell edges of the first and second housing shells and a connector path portion defined by the electrical connector and one of the first and second housing shells, the connector path portion including first and second segments, the first segment of the connector path portion being defined between the first housing shell and the electrical connector and the second segment of the connector path portion being defined between the second housing shell and the electrical connector, the conductive gasket interfacing with the electrical connector along the connector path portion.

12. The electrical connector assembly of claim 1, wherein the housing assembly includes a plurality of sides, the housing seam including a linear portion and a step portion that are defined by the respective shell edges of the first and second housing shells along a same side of the plurality of sides, the linear portion and the step portion forming an angle with respect to each other that is between 70° and 110°, the conductive gasket extending along the linear and step portions.

13. The electrical connector assembly of claim 12, wherein the linear portion is a first linear portion, the housing seam including a second linear portion defined by the respective shell edges of the first and second housing shells, the second linear portion and the step portion forming an angle with respect to each other that is between 70° and 110°, the second linear portion being along the same side.

14. The electrical connector assembly of claim 12, wherein at least one of the first and second housing shells has an open-sided channel that extends along a 3D channel path, the conductive gasket being rigid or semi-rigid such that different segments of the conductive gasket maintain a fixed shape that matches the 3D channel path.

15. A cable assembly comprising:

a cable harness comprising insulated cables;

a housing assembly having first and second housing shells that are coupled to each other and define an interior cavity therebetween, the first and second housing shells having respective shell edges that directly interface each other along a housing seam, the housing seam extending along a three-dimensional (3D) path between the respective shell edges of the first and second housing shells, the housing assembly including a loading passage that receives the insulated cables of the cable harness;

an electrical connector having a back end that is disposed within the interior cavity and a front end that is configured to mate with an external mating connector, the electrical connector being coupled to the insulated cables within the interior cavity; and a conductive gasket having a 3D gasket frame that substantially matches the 3D path of the housing seam between the respective shell edges of the first and second housing shells, the 3D gasket frame being a discrete structure that is positioned along the housing seam to reduce electromagnetic interference (EMI) leakage through the housing seam.

16. The cable assembly of claim 15, wherein the conductive gasket is stamped or cut from a sheet of conductive material and shaped to form the 3D gasket frame, the conductive gasket having a cross-section taken transverse to a path of the housing seam, the cross-section including a height and a thickness, the thickness being defined between two opposite sides of the sheet of conductive material, the height being measured perpendicular to the thickness between two opposite edges of the conductive gasket, the thickness being at least three times the width for a majority of the path of the housing seam.

17. The cable assembly of claim 15, wherein the cable assembly is oriented relative to mutually perpendicular X, Y, and Z axes, the front end facing in a mating direction along the Z-axis, the 3D gasket frame including one or more gasket segments that extend along a plane defined by the X and Y axes and one or more gasket segments that extend generally along a plane defined by the Y and Z axes.

18. The cable assembly of claim 15, wherein the 3D gasket frame includes a cable loop that surrounds the insulated cables.

19. The cable assembly of claim 15, wherein the cable harness includes a shielding layer that surrounds the insulated cables, and a protective jacket that surrounds the shielding layer, wherein the first and second housing shells are electrically conductive, the shielding layer being electrically coupled to the housing assembly, wherein the shielding layer includes a conductive braid that surrounds the insulated cables, the cable assembly including a shield fastener that secures the conductive braid to the housing assembly.

20. The cable assembly of claim 15, wherein the cable harness includes at least twenty-four (24) of the insulated cables.

* * * * *